US007156762B1

(12) United States Patent
Rondinelli

(10) Patent No.: US 7,156,762 B1
(45) Date of Patent: Jan. 2, 2007

(54) METHOD AND APPARATUS FOR PLAYING A COMBINATION FOOTBALL/BASKETBALL GAME

(76) Inventor: Nick J. Rondinelli, 2704 Coventry La., Waukesha, WI (US) 53118-1346

( * ) Notice: Subject to any disclaimer, the term of this patent is extended or adjusted under 35 U.S.C. 154(b) by 0 days.

(21) Appl. No.: 10/694,320

(22) Filed: Oct. 27, 2003

Related U.S. Application Data

(60) Provisional application No. 60/421,751, filed on Oct. 28, 2002.

(51) Int. Cl.
*A63B 67/00* (2006.01)

(52) U.S. Cl. ..... 473/472; 473/470

(58) Field of Classification Search ..... 473/472, 473/136, 415, 465, 470–474; D21/355–359
See application file for complete search history.

(56) References Cited

U.S. PATENT DOCUMENTS

| | | | |
|---|---|---|---|
| 3,544,109 | A | 12/1970 | Woods |
| 3,588,103 | A | 6/1971 | Fuller |
| 3,602,505 | A | 8/1971 | Friend |
| 4,171,808 | A | 10/1979 | Bauer |
| 4,260,154 | A | 4/1981 | Balbastro |
| 4,482,157 | A | 11/1984 | McNeil |
| 4,911,443 | A | 3/1990 | Foster |
| 5,207,433 | A | 5/1993 | Moore |
| 5,588,647 | A | 12/1996 | Rudell et al. |
| 5,722,907 | A | 3/1998 | Paulun |
| 6,045,466 | A | 4/2000 | Suess |
| 6,149,529 | A | 11/2000 | Fowler et al. |
| 6,312,348 | B1 | 11/2001 | Sandell |
| 6,338,686 | B1 | 1/2002 | King |
| 2003/0236138 | A1 * | 12/2003 | Murchison ..... 473/415 |

OTHER PUBLICATIONS

Webpage download, ArmyTM-Multiple Sports Complexes, 1988,www.usace.army.mi/usace-docs/armytm/tm5-803-10/app-d.pdf,2 pages.*

* cited by examiner

*Primary Examiner*—Eugene Kim
*Assistant Examiner*—M. Chambers
(74) *Attorney, Agent, or Firm*—Boyle Fredrickson Newholm Stein & Gratz S.C.

(57) ABSTRACT

A combined football/basketball game is provided. In the game, initially an offensive team attempts to score a touchdown against a defensive team pursuant to an American rules football style of game play. When the offensive team scores a touchdown, the mode of game play shifts to a basketball-mode in which the offensive team attempts to make a basketball shot to score additional points against the defensive team. When the ball is controlled by the defensive team during basketball mode, i.e., after a missed shot or a made shot by the offensive team, the defensive team becomes the offensive team and attempts to score a touchdown in football mode. The game continues in this manner until the end of the time allotted for playing the game.

16 Claims, 1 Drawing Sheet

METHOD AND APPARATUS FOR PLAYING A COMBINATION FOOTBALL/BASKETBALL GAME

CROSS REFERENCE TO RELATED APPLICATION

This application claims priority under 35 U.S.C. § 119(e) to U.S. Provisional Patent Application No. 60/421,751, filed Oct. 28, 2002.

FIELD OF THE INVENTION

The present invention relates to methods of playing games, and more specifically to a method of playing a combination football/basketball game.

BACKGROUND OF THE INVENTION

Football and basketball are highly popular spectator sports. While each of these sports are very different from one another, e.g., they each have very different scoring techniques, there are certain similarities between the games as well, such as the movement of the ball back and forth across the field of play.

Therefore, due to the popularity of each of these sports, it is desirable to develop a game that combines some of the similarities and differences of these games, which are the most popular aspects of football and basketball, and also showcases the athletic skills of individuals playing the game.

SUMMARY OF THE INVENTION

It is an object of the present invention to provide a method of playing a game which combines both the basic scoring systems and methods of game play of football and basketball into a single game.

It is another object of the present invention to combine elements of the games of basketball and American rules football to create a new game that can be played live or can be used to create an electronic or video game.

It is a further object of the present invention to enable the game to be played over a playing surface which can easily be located outdoors or within an indoor facility.

It is still another object of the present invention to provide a game in which the method of playing the game enables the players to showcase the athletic skills necessary for playing both football and basketball.

The present invention is a game which combines both the scoring and game play of American rules football and basketball into a single game. The game is played on a field located outdoors or indoors that is similar in size to an indoor or arena soccer or football field. However, instead of goal posts located at opposite ends of the field, the field utilized in playing the game of the present invention includes a pair of basketball goals including backboards and rims similar to those utilized in conventional basketball games.

The field is divided into three separate sections, namely, a pair of end zones at opposite ends of the field and in which the basketball goals are positioned, and a football-style playing field disposed between the end zones. The game is played by having an offensive team attempt to advance a ball that is preferably shaped similarly to a basketball through the playing field in a manner generally consistent with American rules football. When the offensive team crosses the goal line, points are scored by the offensive team based on the number of plays the offensive team took to cross the goal line. Further, as the ball carrier crosses the goal line, the mode of play of the game shifts from American rules football to basketball. Thus, the offensive team attempts to score a goal in the basketball goal by dribbling the ball and passing and/or shooting the ball towards the goal in a manner consistent with the game play of a conventional basketball game.

If the shot is made by the player on the offensive team, the team which was previously on defense takes over possession of the ball and attempts to score by moving the ball through the playing field towards the opposite end zone in a manner consistent with American rules football. However, if the shot is missed by the offensive player, the game play returns to game play consistent with American rules football and the defensive team can immediately attempt to move the ball towards the opposite end zone.

Various other features, objects and advantages of the invention will be made apparent from the following detailed description taken together with the drawings.

BRIEF DESCRIPTION OF THE DRAWINGS

The following drawing figures illustrate the best mode currently contemplated of practicing the present invention.

In the drawings.

DETAILED DESCRIPTION OF THE DRAWINGS

Figure 1:
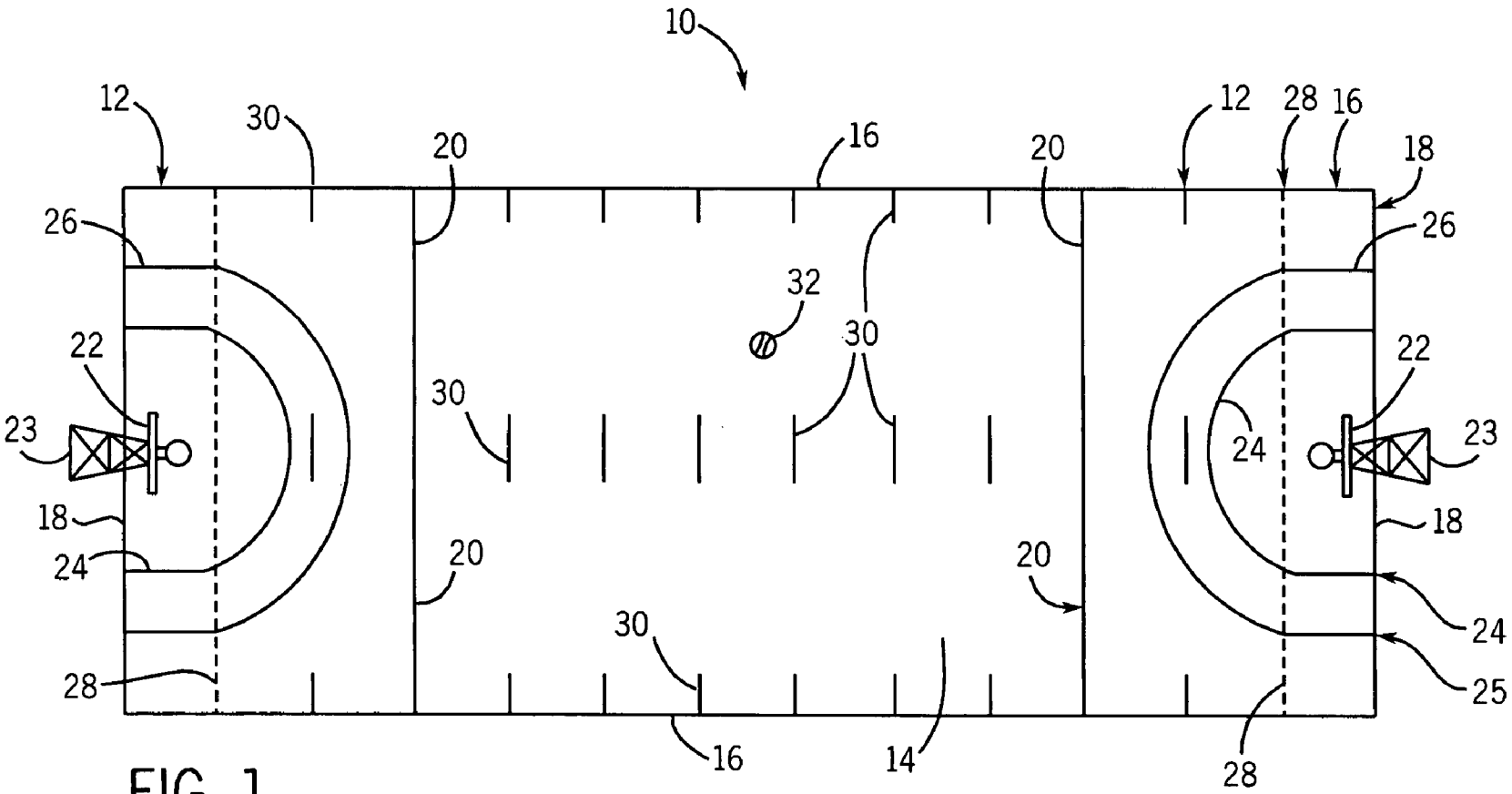
FIG. 1 is a top plan view of the playing field on which the combination football/basketball game of the present invention is played.

With reference to the drawing figure in which like reference numerals designate like parts throughout the disclosure, a playing field 10 is shown in FIG. 1. The field 10 can be located outdoors or indoors and is formed of any suitable material on which a ball can be dribbled, e.g., grass, but is preferably formed of a low nap synthetic grass surface such as Astroturf® or Field Grass® because the game is designed to be played indoors as well as outdoors. The playing field 10 includes a pair of end zones 12 disposed on opposite sides of a central field 14. The field 10 is bounded by a pair of opposed sidelines 16 and opposed base lines 18, and is preferably approximately sixty-five (65) yards in overall length and eighty (80) feet in width, but can be varied in length or width as required.

Each end zone 12 is separated from the central field 14 by a goal line 20 and is approximately fifteen (15) yards in length from the base line 18 to the goal line 20. Each end zone 12 also includes a basketball goal 22 positioned above the end zone 12 adjacent the associated base line 18. The goals 22 are supported by conventional stanchions 23 that can be fixed to the ground or to a ceiling suspended over the field 10, for example, just outside of the end zone 12 adjacent the base line 18. A three-point arc 24 and four-point arc 26 are positioned within the end zones 12 and extend from the base line 18 generally concentrically around the basketball goal 22 to define separate scoring zones within the end zone 12, with the three-point arc 24 being approximately twenty (20) feet from the center of the goal 22, and the four-point arc being approximately thirty (30) feet from the center of the goal 22. Each end zone 12 also includes a dashed safety line 28 extending across the end zone 12 between the sidelines 16 parallel to and spaced five (5) yards inwardly from the base line 18.

The entire playing field 10 also includes a number of yard markers or hash marks 30 disposed along each sideline 16 and down the center of the playing field 10 between the baselines 18. The yard markers 30 are spaced five (5) yards from one another and are used to provide officials and players in the game with reference points to determine how far a player or the ball is from a particular line or area of the field 10 and also to assist officials in marking off yardage penalties that occur during play.

Playing the Game

A. Basic Play

The game is played by two teams with an equal number of players on the field 10, preferably between five (5) and nine (9), and most preferably seven (7). Each team is also allowed to have a maximum number of total players for each game, preferably between twelve (12) and twenty-five (25), and most preferably twenty-one (21).

The game is played with a ball 32 that is preferably generally round in shape and that is capable of being dribbled on the material forming the field 10, such as a basketball. The objective of the game is for an offensive team to first advance the ball 32 across the field 10 past the opposing team's goal line 20 for a touchdown while playing the game in a manner consistent with American rules football. The number of points awarded for the touchdown will vary depending on how the touchdown is scored, as will be described later.

However, should the defensive team prevent the offensive team from crossing the goal line 20, the defensive team is awarded one point and will be given the ball 32 at the base line 18 opposite their end zone 12 and will subsequently put the ball 32 in play as the offensive team.

Once a touchdown is made by the offensive team by crossing the goal line 20 into the associated end zone 12, the offensive team maintains possession of the ball 32 but continues game play within the end zone 12 in a manner consistent with a conventional basketball game. Thus, the offensive players may dribble or pass the ball 32 within the end zone 12 until one of the offensive players attempts to score a goal by shooting, throwing or dunking the ball 32 into the basketball goal 22. The number of points awarded for putting the ball 32 through the goal 22 varies depending on the position in the end zone 12 from where the shot is attempted. Game play continues in this manner during the course of two (2) halves of predetermined length, but preferably thirty (30) minutes, separated by a halftime. The halves may also be subdivided into other parts, such as quarters of fifteen (15) minutes, if desired. Also, each team is given a number of time outs per half, preferably four (4).

B. Starting the Game

To initially determine what team starts the game on offense and what team starts on defense, a coin flip is used, as is well known in either college or professional American rules football. The winner of the coin flip is then given the choice to elect to start the game on either offense or defense or defer the choice to the second half of the game. The team that lost the coin flip will then have the same choice of options at the start of the second half, or if the winning team has deferred, will choose at the start of the first half.

The game then begins by a player on the designated offensive team inbounding the ball by throwing the ball onto the field 10 from outside of the playing field 10 beyond the base line 18 opposite the end zone 12 the offensive team is attempting to reach. The offensive and defensive teams then continue play in football mode.

C. Football Mode

During football mode, the rules of American rules football apply with the following exceptions:

1) On the inbound play, stationary picks or screens are allowed by the offensive team prior to the ball being thrown, and the offensive player receiving the inbound pass, either on the fly or bouncing off the field 10, may elect to run with, dribble or pass the ball to another offensive player. Blocking is allowed during the inbound play and is governed by the rules concerning blocking during a kick off in American rules football. Also, for the defensive team, the coverage and interference rules for American rules football apply for covering the offensive team players during the inbound play.

2) No forward passes are allowed to be made by offensive players during the inbound play after the inbound pass. Violation of this rule results in the end of the play and the ball will be spotted on the field 10 at the point of the illegal pass.

3) There are a limited number of downs given to the offensive team to get to their end zone 12. The offensive team will have only five (5) downs in which to score a touchdown by crossing the goal line 20 of the designated end zone 12. Should the offensive team not score a touchdown within the five (5) downs, e.g., the defensive team prevents the offensive team from moving the ball past the goal line 20, such as by intercepting either the inbounds pass or a pass on any of the five (5) subsequent downs, the defensive team is awarded one point. The defensive team then becomes the offensive team by putting the ball in play using the above-mentioned inbounds play from the base line 18 opposite their designated end zone 12 and goal line 20 unless the ball is intercepted or recovered as a fumble. In this particular situation, the defensive and offensive teams switch roles instantaneously and continue play in either football or basketball mode, depending on which part of the field 10 the ball became controlled by the defensive team.

4) The offensive team must have four (4) players positioned on the line of scrimmage or in line with the ball 32, and three (3) players positioned behind the line of scrimmage in the backfield at the start of each down, with one player in the backfield also allowed to be moving parallel to or away from, but not toward, the line of scrimmage.

5) All offensive players are allowed to run with the ball or go down field on pass plays and catch passes. Pass blocking rules that apply to receivers in American rules football apply to all of the offensive players, i.e., blocking down the field 10 is only allowed after the ball 32 is caught.

6) Forward bounce passes are allowed, one (1) bounce only. If a pass hits an offensive or defensive player on a fly and deflects off of that player (or multiple players) without hitting the field 10, the ball 32 can still bounce once off of the field 10 and be caught by either team for a legal pass reception.

7) In addition to the regular penalties of amounts of yardage for violations of the rules of American football, free throws will be awarded to the non-penalized team for each violation in the following manner:

5 yard penalty=1 free throw 10 yard penalty=2 free throws 15 yard penalty=3 free throws The free throws awarded during football mode shall be shot by each team at the end of each time period, i.e., quarter or half. Each team will shoot their accumulated free throws by use of a shooting order determined and submitted to officials and/or the other team prior to beginning the game. All players must participate in the predetermined order, including bench players who have played but are not currently playing, or have not yet participated in playing the game. The team who has the higher score at the end of the quarter or half will shoot all of their accumulated free throws first, followed by the other team. The free throws are shot from inside one of the end zones 12 and can be attempted from behind the safety line 28, from behind the three-point arc 24 or from behind the four-point arc 26, with a made free throw being awarded one (1), three (3) or four (4) points, respectively, to the team of the player who made the free throw.

D. Transition From Football to Basketball Mode

When an offensive player crosses the goal line 20 with the ball 32 unencumbered, i.e., is not in the process of being tackled by a defensive player, the game shifts to basketball mode and conventional basketball rules now apply within the end zone 12 such that game play is continuous. However, if the offensive player is being tackled while crossing the goal line 20, play will be stopped by an official and the offensive player who crossed the goal line 20 with the ball 32 will be given possession of the ball 32 at that spot within the end zone 12. The defensive players must give the offensive player with the ball 32 five (5) feet of space and play will resume in basketball mode upon a signal given by an official.

E. Basketball Mode

When the ball 32 is in play within an end zone 12, traditional basketball rules apply with the following exceptions:

1) There is no lane.

2) There is no three-second violation.

3) All fouls committed in basketball mode are one-shot shooting fouls.

4) Players have an unlimited number of fouls and cannot foul out of the game.

5) Any player on the offensive or defensive team can shoot the foul shot regardless of whether he was the offensive or defensive player who was fouled. More specifically, when a foul is called by an official, the fouled player will be given the ball 32 at the spot where he was fouled. That player may shoot the ball 32 or pass it to any other player on the fouled team in the end zone 12 and that player is free to shoot or pass the ball 32 as well. Players on the fouling or opposing team can be anywhere in the end zone 12 but must be spaced at least five (5) feet from players on the fouled team and may not be positioned between the player shooting the ball 32 and the goal 22 where the foul shot is taken. Further, any number of players on the fouled team may handle the ball 32 but the foul shot must be attempted within ten (10) seconds from when the official gave the ball 32 to the fouled player. A violation of the ten-second time limit results in loss of the chance to attempt the foul shot. The foul shot may be attempted by a player from the safety line 28 for one (1) point or from behind the three or four-point areas 24 and 26 for three (3) or four (4) points, respectively. There is no rebounding of the foul shots by the fouling team. The offensive team at the time of the foul will put the ball back in play to continue in basketball mode from one of the sidelines 16 regardless of whether the foul shot is made or missed.

6) When a field goal or basketball shot is attempted by the offensive team in basketball mode, full football contact is allowed, and American football rules regarding a football fumble apply. If the shot is good, all contact between the players must stop and the ball 32 is given to the defensive team to be inbounded, or put into football mode, by the defensive team at the adjacent base line 18.

However, if the shot is not good, contact between the players may continue until the ball 32 is controlled by a player from one of the teams. If the ball 32 is controlled by the offensive team, the basketball mode begins again and contact must stop until another shot is attempted by an offensive player. If the offensive team controls the ball 32 but is encumbered or tackled by a defensive player while controlling the ball 32, play will stop, the defensive team will yield five (5) feet to the offensive player controlling the ball 32, and basketball mode will continue upon a signal from an official. In this situation, the ball 32 does not have to be put back into play within the end zone 12 from beyond a sideline 16 or the baseline 18.

If the rebound is controlled by a player from the defensive team, game play in the end zone 12 continues in football mode and the defensive player with the ball 32 can advance the ball 32 as if the ball 32 had been inbounded to the defensive player from behind the base line 18 in the manner used to start the game. The defensive team will advance the ball 32 pursuant to the rules covering an inbounds play, as described previously, until a defensive player with the ball 32 is tackled, or forced out of bounds or until the defensive player with the ball 32 crosses the opposite goal line 20 to score a touchdown.

F. Safety Line

The safety lines 28 are positioned in each end zone 12 to give the offensive team a safety zone of at least a minimum amount of room on the field 10 to run plays in the football mode. Thus, when the offensive player on an inbound play or defensive player on a rebound of a missed basketball shot is tackled between the base line 18 and the safety line 28, the ball 32 will be spotted on the safety line 28 to allow the offensive team to use the area behind the safety line 28 to run a football play. Further, if an offensive player with the ball 32 is tackled behind the safety line 28 by a defensive player, the offensive team will lose possession of the ball 32, regardless of which down the tackle behind the safety line 28 occurred on, and the defensive team is awarded two (2) points in addition to the one (1) point for preventing the offensive team from crossing the goal line 20 in the allotted five downs. The defensive team is also awarded two (2) points if the ball 32 goes out of play backwards through the baseline 18, such as when the ball 32 is mishandled, i.e., fumbled, by the offensive team and passes backward over the safety line 28 and past the baseline 18.

Scoring

A. Scoring in Football Mode

1) Ten (10) points are awarded when (a) the offensive team crosses the goal line 20 without running a play from scrimmage and only dribbling and/or lateral or backward passes of the ball 32 are used to advance the ball 32 past the goal line 20, (b) the ball 32 is intercepted or recovered after a fumble beyond the goal line 20, or (c) the inbound pass of the ball 32 is caught by an offensive player beyond the goal line 20 inside the end zone 12;

2) Six (6) points are awarded when (a) the offensive team crosses the goal line 20 without running a play from scrimmage and by running with the ball 32 in football mode at any time during the inbounding play, or (b) a fumble or interception is run by a defensive player past the goal line 20;

3) When the offensive team does not cross the goal line 20 on the inbounding play, and the ball 32 is placed on the field 10 for play in football mode in which the offensive team subsequently crosses the goal line 20, the number of points awarded to the offensive team for crossing the goal line 20 vary depending on what down the offensive team crosses the goal line 20:

5 points for crossing the goal line 20 with the ball 32 on 1 st down 4 points for crossing the goal line 20 with the ball 32 on 2nd down 3 points for crossing the goal line 20 with the ball 32 on 3rd down 2 points for crossing the goal line 20 with the ball 32 on 4th down 1 point for crossing the goal line 20 with the ball 32 on 5th down;

4) One (1) point is awarded to the defensive team for stopping the offensive team from crossing the goal line 20 with the ball 32 on all five downs; and 5) Two (2) points are awarded to the defensive team for tackling an offensive player with the ball 32 behind the safety line 28 or when the offensive team misplays the ball 32 backwards past the safety line 28 and beyond the baseline 18.

B. Scoring in Basketball Mode

1) Two (2) points are awarded for a field goal made by the offensive team inside the three-point arc 24;

2) Three (3) points are awarded for a field goal made by the offensive team outside the three-point arc 24 but inside the four-point arc 26;

3) Four (4) points are awarded for a field goal made by the offensive team beyond the four-point arc 26;

4) One (1) point for a free throw or foul shot made by either team from beyond the safety line 28 but inside the three-point arc 24;

5) Three (3) points for a free throw or foul shot made by either team from beyond the three-point arc 24 but inside the four-point arc 26; and 6) Four (4) points for a free throw or foul shot made by either team from beyond the four-point arc 26.

Further, while the different modes of play and scoring rules of the game are described with regard to outdoor and indoor play of the game, the invention also covers the play of the game in any electronic format where the game and teams are displayed on a screen and controlled by individuals using specific electronic input devices such as video game controllers. Also, while the preferred embodiment of the game involves full contact between game participants, the game can also be played using a tag as a substitute for a tackle so that the game can be played on other outdoor or indoor surfaces such as asphalt or a hardwood floor.

Various alternatives are contemplated as being within the scope of the following claims particularly pointing out and distinctly claiming the subject matter regarded as the invention.

I hereby claim:

1. A method of playing a game comprising the steps of:

a) providing a field formed with grass or a grass-like surface including a central playing area including distance lines marked on the central area, a pair of end zones at opposite ends of the central playing area and separated from the central area by goal lines marked between the central area and the end zones, and a pair of basketball goals positioned in the end zones;

b) allowing the offensive team in a football mode to attempt to move the ball across the field into one of the end zones and score points by running, dribbling, or passing the ball over the field while the defensive team attempts to prevent the offensive team from doing so; and c) allowing the offensive team in a basketball mode to attempt to make a basketball goal against the defensive team by dribbling or passing, and shooting the ball at the basketball goal after moving the ball into the one of the end zones.

2. The method of claim 1 further comprising the step of allowing the offensive team to attempt to inbound the ball onto the playing field against the defensive team prior to attempting to move the ball into the one of the end zones.

3. The method of claim 2 wherein the step of allowing the offensive team to inbound the ball comprises:

a) placing a ball at a baseline of the field opposite the one of the end zones; and b) allowing a first offensive player on the base line to attempt to throw the ball to a second offensive player on the field.

4. The method of claim 3 further comprising the step of allowing the second offensive player to run with, dribble or pass the ball to another offensive player after receiving the ball from the first offensive player.

5. The method of claim 1 wherein the step of allowing the offensive team to attempt to move the ball into one of the end zones comprises:

a) providing the offensive team with five downs to move the ball into one of the end zones; and b) enabling the offensive team to run or throw the ball on each down to attempt to move the ball into the one of the end zones.

6. The method of claim 5 wherein the points awarded to the offensive team for moving the ball into the one of the end zones are dependent upon the number of downs required to move the ball into the one of the end zones.

7. The method of claim 5 further comprising the step of awarding points to the defensive team if the offensive team does not move the ball into one of the end zones after all of the five downs.

8. The method of claim 5 further comprising the step of placing the ball on a safety line generally opposite the one of the end zones prior to providing the offensive team with the five downs.

9. The method of claim 5 further comprising the steps of:

a) calling a penalty on the offensive team or the defensive team during play in football mode; and b) awarding a number of foul shots to be taken at the end of a playing period to the non-penalized team.

10. The method of claim 1 wherein the step of allowing the offensive team to attempt to make a basketball goal comprises:

a) enabling the offensive team to dribble and pass the ball between offensive team players; and b) enabling the offensive team players to shoot the ball at one of the pair of basketball goals located in the one of the end zones.

11. The method of claim 10 wherein the one of the end zones is separated into different scoring areas and the points awarded to the offensive team for making the basketball goal vary upon the particular scoring area from which the shot was attempted by the offensive team.

12. The method of claim 10 further comprising the step of switching the mode of play from basketball mode to football mode immediately after the shot is attempted by the offensive team.

13. The method of claim 12 further comprising the step of switching from football mode back to basketball mode if a missed shot is controlled by the offensive team.

14. The method of claim 10 further comprising the steps of:

a) calling a foul on either the offensive team or the defensive team after enabling the offensive team to dribble or pass the ball; and b) enabling the team that was fouled to pass and shoot the ball to attempt a foul shot.

15. The method of claim 14 further comprising the step of enabling the offensive team to continue playing in basketball mode after the foul shot is attempted.

16. A method of playing a game comprising the steps of:

a) providing a field formed with grass or grass-like surface including a central playing area including distance lines marked on the central area, a pair of end zones at opposite ends of the central playing area and separated from the central area by goal lines marked between the central area and the end zones, and a pair of basketball goals positioned in the end zones;

b) allowing the offensive team in a first mode to attempt to move the ball across the field into one of the end zones and score points in the first mode by running dribbling or passing the ball over the field while the defensive team attempts to prevent the offensive team from doing so; and c) allowing the offensive team in a second mode to attempt to make a basketball goal against the defensive team in the second mode by shooting the ball at the basketball goal after moving the ball into the one of the end zones.

* * * * *